US006550702B2

(12) United States Patent
Champlin

(10) Patent No.: US 6,550,702 B2
(45) Date of Patent: Apr. 22, 2003

(54) APPARATUS FOR REMOVING AND CHIPPING WOOD SCRAPS

(76) Inventor: William R Champlin, P.O. Box 1203, Lake Stevens, WA (US) 98258-1203

( * ) Notice: Subject to any disclaimer, the term of this patent is extended or adjusted under 35 U.S.C. 154(b) by 0 days.

(21) Appl. No.: 09/796,567

(22) Filed: Feb. 28, 2001

(65) Prior Publication Data

US 2001/0032899 A1 Oct. 25, 2001

Related U.S. Application Data

(60) Provisional application No. 60/185,728, filed on Feb. 29, 2000.

(51) Int. Cl.[7] ..... B02C 18/06

(52) U.S. Cl. ..... 241/55; 241/56; 241/92; 241/186.2; 241/291

(58) Field of Search ..... 241/55, 56, 57, 241/58, 60, 79.1, 92, 101.2, 186.2, 291

(56) References Cited

U.S. PATENT DOCUMENTS 3,712,353 A * 1/1973 Ferry ..... 241/101.78
3,869,773 A * 3/1975 Gmeiding ..... 241/92
4,277,995 A * 7/1981 Sontheimer ..... 241/92
4,824,034 A * 4/1989 Baker ..... 241/101.2
5,018,672 A * 5/1991 Peck et al. ..... 241/101.78
5,156,345 A * 10/1992 Baker ..... 241/101.78
5,469,901 A * 11/1995 Leguin ..... 144/162.1
5,961,057 A * 10/1999 Turner ..... 144/176

* cited by examiner

*Primary Examiner*—John M. Husar
(74) *Attorney, Agent, or Firm*—Todd N. Hathaway

(57) ABSTRACT

An apparatus for receiving wood scraps from a work area and reducing the scraps to wood chips having a saleable consistency and size. The apparatus includes a combined chipper and a blower section, the chipper section being mounted on the intake side of the blower section so that the blower section draws the wood scraps into the chipper section, and then draws the resulting chips from the chipper section and discharges them to a predetermined collection area. The chipper section includes a grate having a plurality of through openings, and a rotating chipper blade that is positioned in front of the grate. The blower fan is mounted behind the grate so as to receive the chips passing therethrough, and discharges the chips through an opening in the surrounding housing. A flexible hose or other conduit may be mounted to the intake opening of the chipper section for vacuuming up and collecting wood scraps from the work area. A vertically extending chute may also be included for combined gravity and vacuum feed of the wood scraps.

25 Claims, 8 Drawing Sheets

APPARATUS FOR REMOVING AND CHIPPING WOOD SCRAPS

This application claims the benefit of provisional application No. 60/185,728, filed Feb. 29, 2000.

BACKGROUND a. Field of the Invention

The present invention relates generally to systems for removal and processing of solid waste material, and, more particularly, to a system for removing wood scraps from a work area and for reducing the scraps to merchandisable wood chips.

b. Related Art

Virtually all woodworking operations generate wood scraps of one form or another. Examples of woodworking operations include lumber mills and cabinet shops, among others, and the scraps that they generate range from mere shavings up to pieces of 2×4 or 2×6 lumber.

In a busy production facility, the wood chips tend to pile up around the cutting area, often interfering with work and creating an unsafe work environment. As a result, the scraps must be removed on a periodic basis, typically by hand or by using a shovel or similar implement. This is, of course, both tedious and wasteful of valuable man-hours.

Furthermore, the wood scraps usually vary greatly in size and shape and are not merchandisable in unprocessed form. If chipped and reduced to a smaller, somewhat uniform size they can be sold for use in playgrounds, livestock stalls, landscaping and other purposes. Most conventional chippers, however, are unable to handle widely different sizes of chips without having to be hand-fed; for example, in some installations the scraps are transported away from the work area by a conveyer or other means and are then fed into a chipper by hand. Moreover, potentially harmful foreign objects, such as rocks and pieces of steel, are often found intermixed with the scraps, and have to be removed by hand in order to avoid causing serious damage to the internal components of conventional chippers.

Thus, while chipping does yield a saleable product, the additional time and labor required in order to transport and hand feed the scraps often renders this option uneconomical, given the relatively low prices which wood chips command in the market. As a result, the scraps from many woodworking facilities are simply burned or disposed of as garbage or solid waste, often at considerable expense.

Compounding this problem, conventional chippers are both expensive and inefficient. For example, one form of chipper, known as a "hammer hog", uses a series of moving hammers to splinter and crush the wood scraps. However, by nature of their operation, hammer-hog machines must be heavily constructed and consequently tend to be prohibitively expensive. These machines also require powerful (e.g., a 30+horsepower) motors in order to function properly, so that power consumption and operating costs tend to be excessively high. Still further, conventional hammer hog machines do nothing to address the problems of transporting and feeding the scraps into the machine that has been described above; in some instances, a separate blower has been connected to the hammer hog machine to move the wood chips away from the discharge, but this does not aid in transporting the chips to the machine. Furthermore, the use of a separate blower adds to the complexity and expense of the installation, and the additional motor needed for the blower adds significantly to the already high costs of operating a hammer hog machine.

Accordingly, there exists a need for an apparatus for removing varying sizes of wood scraps from a work area in a quick and efficient manner. Furthermore, there exists a need for such an apparatus that will reduce the scraps to saleable wood chips having a small, substantially uniform size. Still further, there exists a need for such an apparatus that can reliably process wood scraps having a wide variety of sizes and shapes (typically, small to mid-size chips) with less need for manual feeding and handling. Still further, there exists a need for such an apparatus that is able to process a substantially steady flow of wood scraps with minimal clogging or jamming. Still further, there exists a need for such an apparatus that is capable of discharging the processed wood chips into a selected collection area. Still further, there exists a need for such an apparatus in which the internal components have a reduced vulnerability to damage by occasional foreign objects, such as rocks and pieces of steel, in the feed material. Still further, there exists a need for such an apparatus that requires comparatively little power in order to function properly, so as to be able to operate at a reduced cost and with lower energy consumption.

SUMMARY OF THE INVENTION

The present invention has solved the problems cited above, and is an apparatus for removing wood scraps from a work area by employing a vacuuming action and then reducing these to wood chips having a saleable consistency and size.

Broadly, the apparatus comprises a chipper section for reducing the scraps to wood chips, and a blower section which generates the vacuum for drawing the scraps into the chipper section, and which then draws the chips from the chipper section and discharges them to a predetermined collection area.

In a preferred embodiment, the apparatus may comprise a combined chipper and blower assembly having the chipper section mounted in fluid communication with an intake side of the blower section. The chipper section may include a chipper grate which is mounted over the intake opening of the blower section, and a rotating cutter blade for reducing the scraps to wood chips as these pass through the grate.

The blower section, in turn, may comprise a blower fan having a plurality of vanes for generating the vacuum, and for discharging the air and wood chips under pressure. The fan may comprise a plurality of rotating vanes that are mounted behind the chipper grate so as to receive the wood chips that pass therethrough. The grate also protects the vanes from damage by harmful debris in the feed material. The blower section may further comprise a tangential discharge chute for receiving the wood chips that are discharged by the vanes.

The chipper blade and the blower fan may be mounted for rotation on a common driveshaft. The driveshaft may take its power from an external source, such as an electric motor or an I/C engine, and may extend substantially coaxially through the blower and chipper sections of the assembly.

The chipper blade may have a stepped configuration in which there are upper and lower blade sections. The upper blade section may have a cutting face with a sharply angled edge for penetrating and cutting the wood scraps and for drawing air and debris towards the chipper grate. The lower blade section may have a cutting face with an only slightly angled edge for shearing the wood scraps as they enter the openings in the chipper grate. The upper and lower blade sections may be provided with corresponding cutting faces on their leading and trailing edges so as to permit reversible mounting of the blade sections.

A stationary anvil plate may be mounted in the chipper section so as to block the wood scraps from rotating freely therein and so as to force the scraps into cutting engagement with the rotating chipper blade. The anvil plate may be mounted so that this can be selectively inverted so as to present a fresh, sharp edge to the chipper blade without having to be replaced.

These and other features and advantages of the present invention will be further understood from a reading of the following detailed description with reference to the accompanying drawings.

DETAILED DESCRIPTION a. Structure

Figure 1:
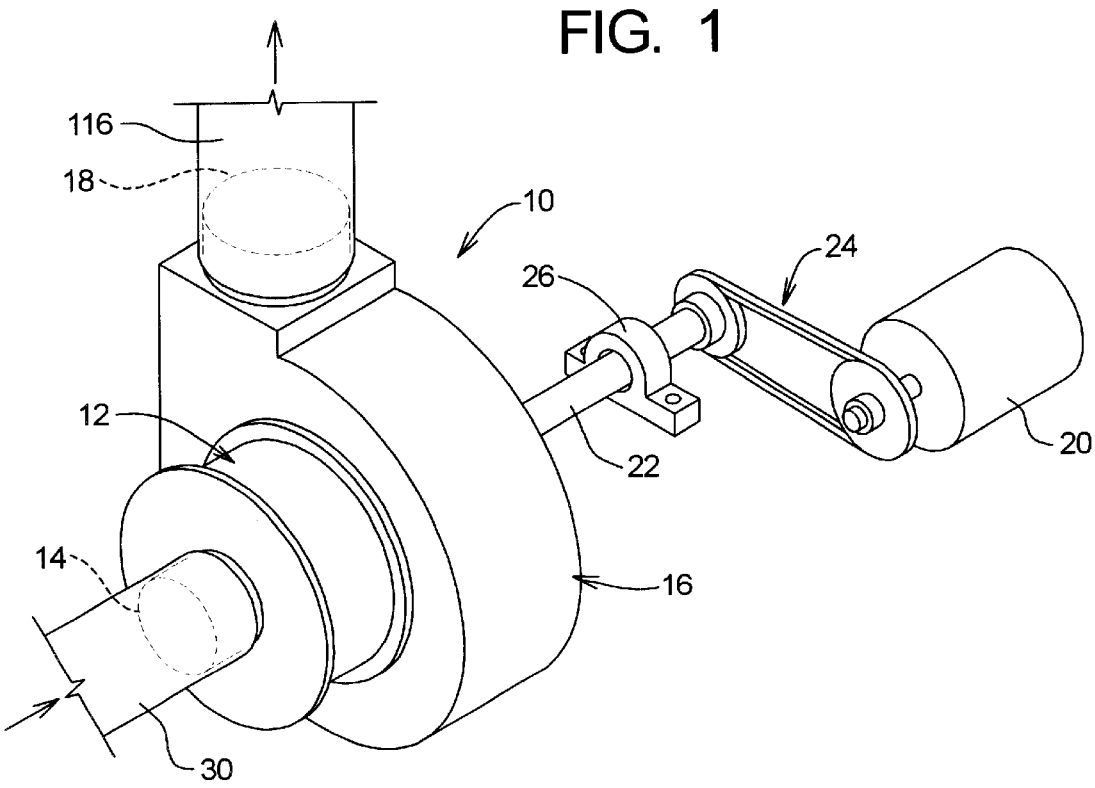
FIG. 1 is a perspective view of a wood scrap removal and chipping apparatus in accordance with the present invention, showing the combination chipper-blower assembly thereof.

As can be seen in FIG. 1, the principal component of the present invention is a combination chipper-blower assembly 10. This includes a chipper section 12 having an intake opening 14 through which the wood scraps enter the assembly, and a blower section 16 having a discharge opening 18 through which the processed chips exit the assembly. As will be described in greater detail below, the blower section generates the vacuum which transports the wood scraps into and through the assembly.

Power is supplied to the assembly by an electric motor 20 or other suitable source (e.g., a gasoline or diesel engine), which is connected to the main drive shaft 22 of the assembly via a belt drive 24 or other suitable transmission. In the embodiment which is illustrated, the outboard end of the drive shaft is supported by two pillow block bearings 26 (only one of these being is visible in FIG. 1), while the inboard end is supported by a flange bearing which is mounted on a supporting bridge piece 28 which spans the opening at the junction between the chipper and blower sections 12, 16 (see FIG. 3).

The suction generated by the blower section draws the wood scraps into the assembly via an intake conduit 30. In some embodiments, the intake conduit may be a fixed and/or rigid conduit having a stationary intake end which is positioned adjacent to a saw or other work area; this configuration may be particularly suited to a production operation in which the wood scraps are initially deposited in a single, relatively well-defined area. In other embodiments, however, the conduit (or the intake section thereof) may be formed of flexible material, so as to permit the intake opening to be moved about the work area; this allows greater flexibility for gathering scraps from the floor and various parts of the work area, much in the same manner that the flexible hose of a vacuum cleaner can be moved about to reach dirt and dust in various spots.

Figure 2:
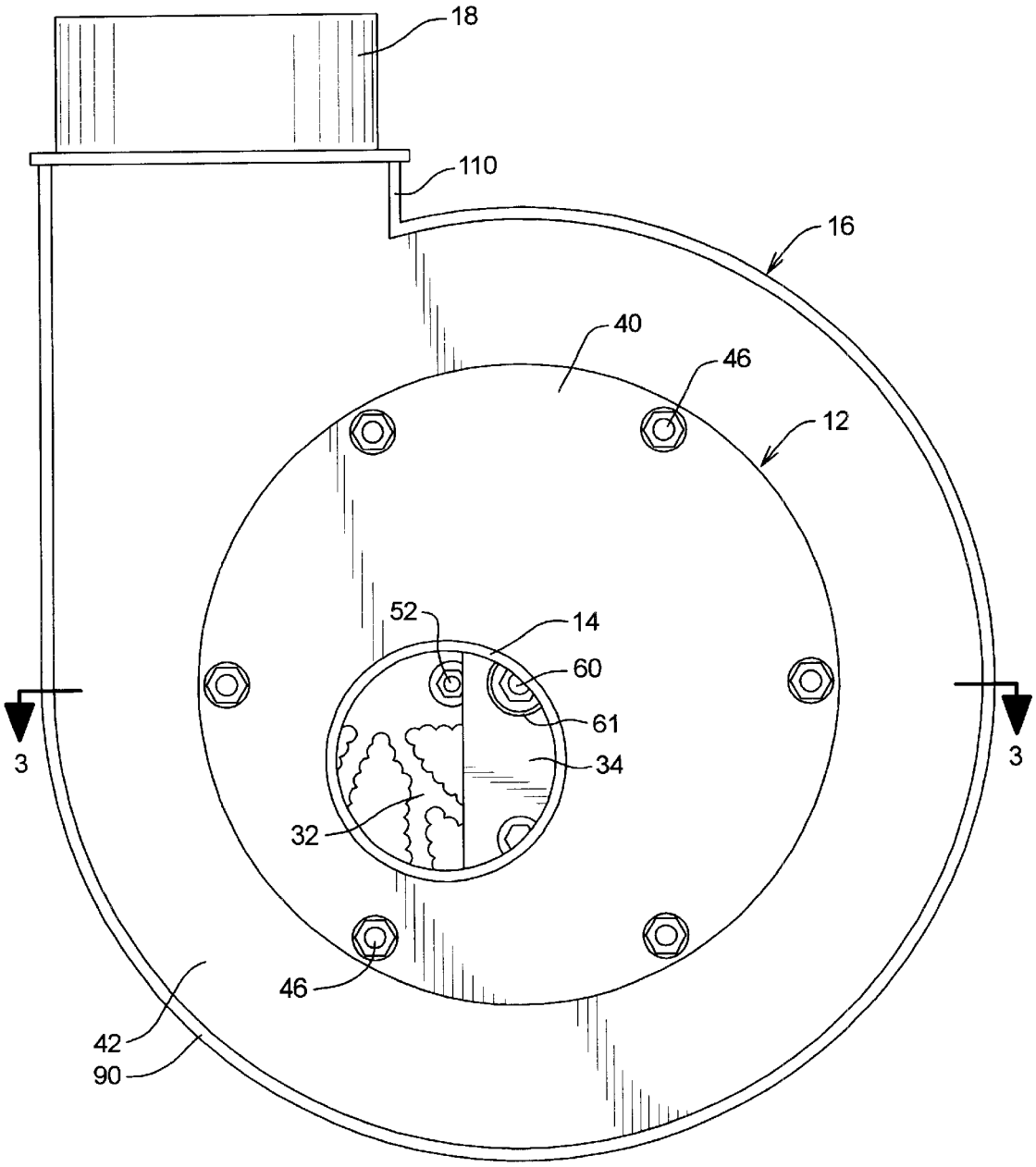
FIG. 2 is an end, elevational view of the chipper-blower assembly of FIG. 1, showing the inlet opening through which wood scraps enter the assembly.
Figure 3:
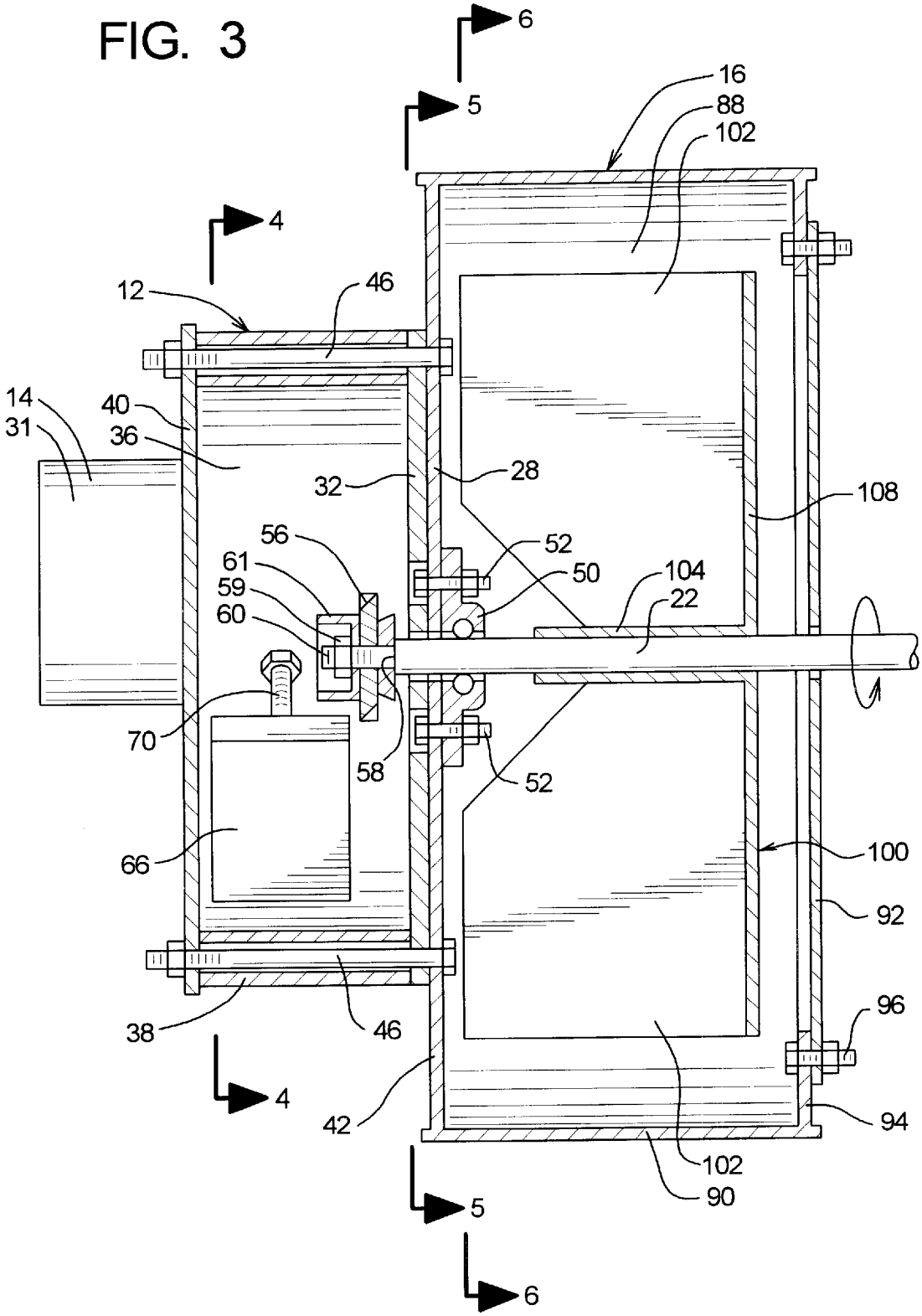
FIG. 3 is a cross sectional view, taken along line 3—3 in FIG. 2, showing the arrangement of the chipper and blower sections of the combined assembly of FIGS. 1–2.

As can be seen in FIGS. 2 and 3, the wood scraps pass from conduit 30 into the intake opening 14 of the chipper section 12, on a substantially straight-line path towards a chipper grate 32 and rotating chipper blade 34. As can best be seen in FIG. 3, the chipper section of the assembly includes a feed chamber 36 which is defined by a generally cylindrical outer wall 38 and circular cover plate 40 which incorporates the intake opening 14 and associated attachment collar 31. The rearward face of the chipper section is joined to the forward plate or face 42 of the blower section, so that fluid communication is established between the sections opening via chipper grate 32. The chipper section and grate are secured to the face of the blower section by bolts 46. The bridge piece 28 is formed as an integral part of the blower face 42, and a flange bearing 50, in turn, is mounted in the center of the bridge piece by bolts 52 so as to support the inboard end of drive shaft 22.

As can be seen with further reference to FIG. 3, drive shaft 22 extends coaxially through the interior of the blower section and into the interior of the chipper section. A rotating blade 56 is mounted to a milled square or oblong section 57 (see FIG. 7) formed on the end of the drive shaft, a shoulder 58 on the shaft serving to position the blade a short, predetermined distance from the surface of the chipper grate 32. In the embodiment that is illustrated, the blade is retained on the shaft by a nut 59 on the threaded end 60 of the shaft. A guard collar 61 having a base flange 62 portion surrounds the nut and protects it from striking and being loosened by the wood scraps in the chipper section; for removal/installation, the nut is easily accessed by inserting a socket into the interior of the protective collar 61. As will be described in greater detail below, the chipper blade 56 preferably has a particular, "stepped" configuration, which facilitates efficient and reliable operation of the combined chipper-blower assembly.

Figure 4:
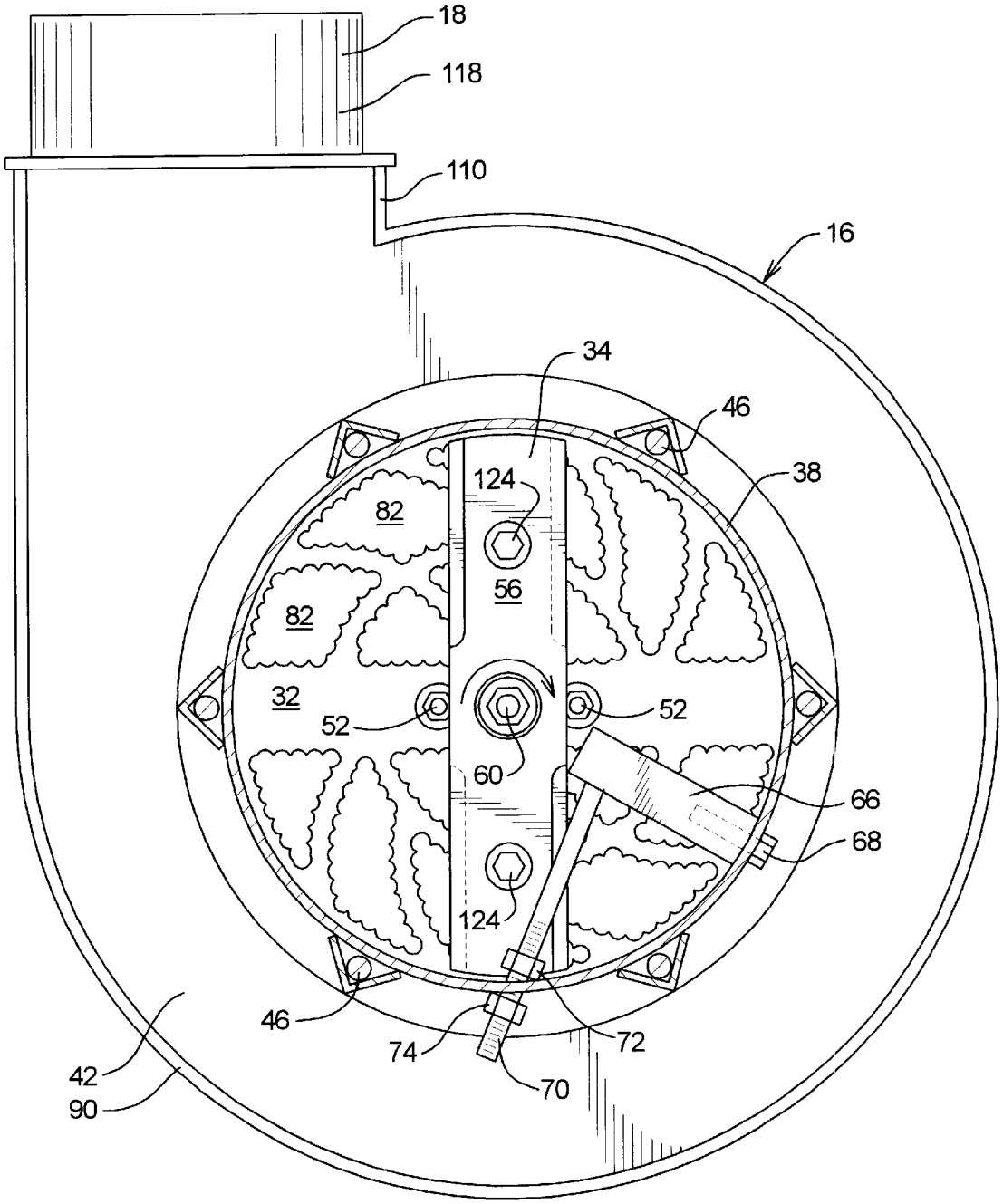
FIG. 4 is a cross-sectional view, taken along line 4—4 in FIG. 3, showing the rotating blade and chipper grate of the assembly.

Also mounted within the interior of the chipper section is a stationary anvil plate 66, which serves to prevent the wood scraps from rotating or spinning freely within the chipper section, and to force the material into cutting engagement with the chipper blade, in the area between the anvil and grate 32. The outer portion of the stepped blade thus shears and "chops" the scraps against the anvil plate, with the resulting pieces being sheared against and forced through the chipper grate and into the blower section by the inner portion of the blade. As can be seen in FIG. 4, the anvil plate 66 extends into the chamber in a generally radial direction, i.e., generally perpendicular to the path of the wood scraps which is induced by rotation of the chipper blade.

In the illustrated embodiment, the anvil plate is mounted to the wall 38 of the chipper section by two bolts 68 which extend into the base thereof, and is supported by a prop rod 70 which engages the back surface of the anvil plate and extends generally perpendicularly therefrom. In the embodiment which is illustrated, the prop rod is adjustable to move closer or further from the cutting leading edges of the outer chipper blade so as to adjust the size of cuts and also to compensate for wear, using first and second adjuster nuts 72, 74 which engage the rod where this extends through a corresponding hole in the wall of the chipper section. In other embodiments, however, the back support may be formed integrally with the anvil plate, or the anvil plate may be provided with another form of support; such as a simple, welded gusset.

Although the anvil plate provides the advantages described above, it may be considered somewhat optional and may not be present in all embodiments of the invention, particularly where producing consistent, comparatively small-sized chip material is not critical. The anvil plate is also less necessary when the chipper and blower sections are arranged horizontally for vertical-feed operation, as will be described in greater detail below.

Figure 5:
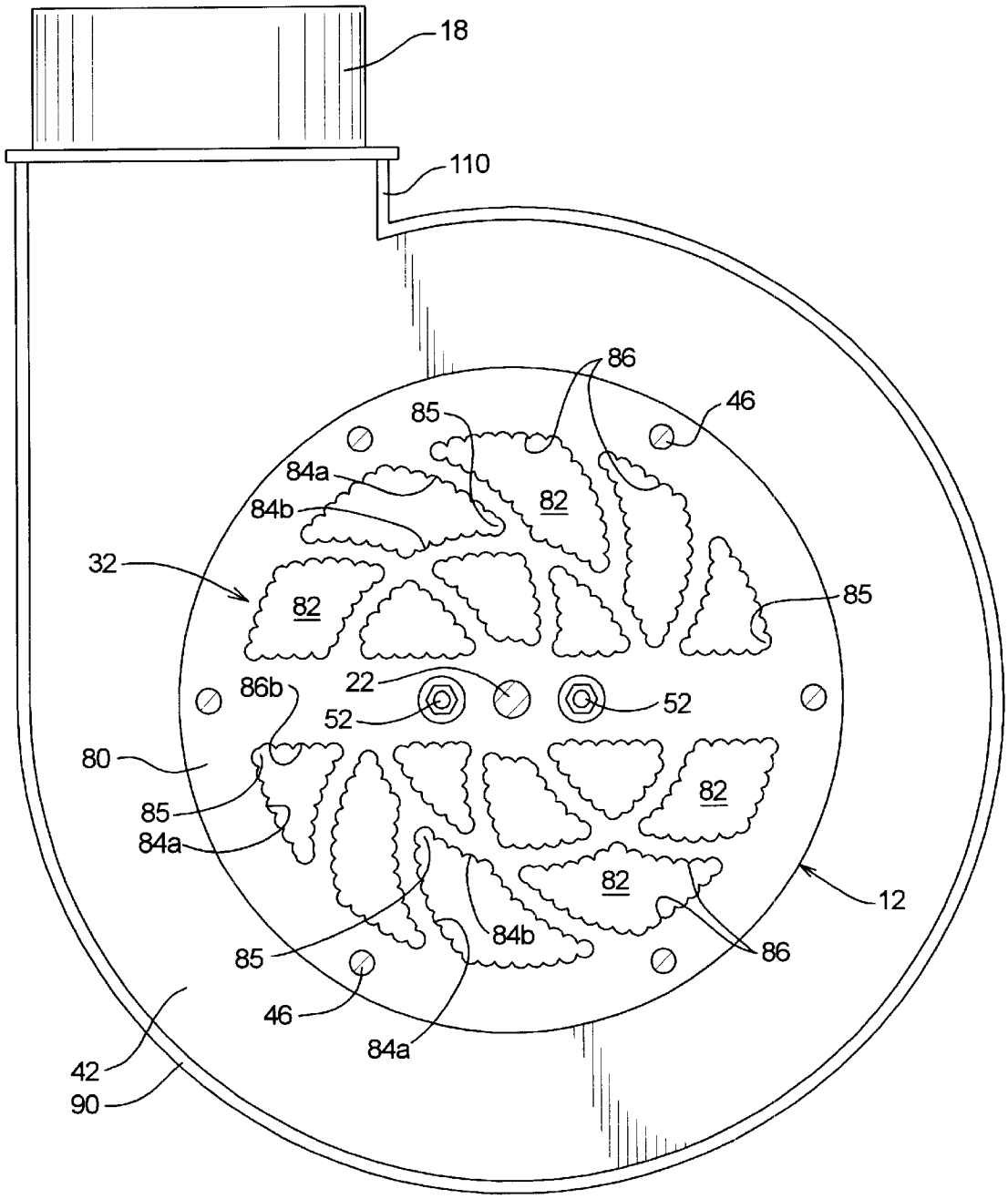
FIG. 5 is a cross-sectional view, taken along line 5—5 in FIG. 3, showing the configuration of the chipper grate in greater detail.

As was noted above, the incoming wood scraps are drawn towards the chipper grate 32 by the flow of air that passes therethrough. As can be seen in FIG. 5, the chipper grate comprises a flat plate number 80 (e.g., a circular steel plate) having a plurality of through openings 82 formed therein. The grate openings are dimensioned to permit a wood chip of a predetermined maximum size (e.g., 1.5") to pass therethrough. In the embodiment which is illustrated, the grate openings are arranged in a radially-extending array around the center of the plate member and are formed with somewhat curved, accurate edges, so that the trailing side edges 84*a*, 84*b* of each opening converge to define somewhat pointed ends 85 in the general direction towards which the chipper blade is rotating. The trailing ends 85 of the openings thus act somewhat in the manner of a set of jaws, into which the wood scraps are forced by the rotating blade and in which they are temporarily captured, thereby helping to ensure complete and efficient cutting of the scraps before they pass through the chipper grate. It will be understood, however, that in other embodiments the arrangement and configuration of the grate openings may vary somewhat from that which is shown.

Moreover, in the preferred embodiment that is illustrated in the figures, the edges of the grate openings are formed with a multiplicity of shallow teeth 86. These serve to engage the edges of the wood scraps with a slight gripping action, so as to prevent over-large scraps from accidentally passing lengthwise through the opening without being caught and cut by the chipper blade; again, however, it will be understood that the edge teeth 86 may or may not be present in other embodiments of the apparatus, e.g., in some embodiments the openings may have smooth edges.

Once the scraps have been reduced to the desired size, the resulting wood chips are drawn through the grate openings and into the interior 88 of the blower section 16. The cylindrical housing of the blower section is defined by the face plate 42, a cylindrical outer wall 90, and a rearward face plate 92, the latter being detachably mounted to an annular flange 94 by bolts 96 so as to allow periodic removal for maintenance and repair of the assembly.

A blower fan 100 having a plurality (six, in the embodiment which is illustrated) of vanes 102 is mounted to rotating shaft 22 directly behind chipper grate 32, on the opposite side from blade 56. As can be seen in FIG. 3, the blower fan includes an elongate central sleeve portion 104 and set screw 106 (see FIG. 5) for engaging the drive shaft in stable interfit therewith. A circular back plate 108 is mounted to the sleeve portion and the rearward edges of the blower vanes, both to support the vanes and to prevent wood chips from working into the area around the drive shaft entrance. Also, with reference to FIG. 3, it will be noted that the outer edges of the blower vanes 102 and the back plate 108 extend a significant distance beyond the perimeter of the openings and the chipper grate 32; this not only helps the blower to develop a strong vacuum action, but also defines areas or "pockets" between the blades for efficiently capturing and discharging the chips which are received from the chipper grate.

The location of the blower section, behind the chipper grate, serves to protect the vanes and other parts of the blower from direct damage by rocks, metal pieces, and other harmful debris in the feed material. The hardened blade is better able to withstand contact with such debris, and is easily and inexpensively sharpened or replaced if damaged; if large, resistant debris becomes lodged in the grate, the blade simply jams and the drive belt slips, rather than the object passing through and into contact with the comparatively delicate and expensive blower vanes. In either case, expensive damage to the mechanism is averted.

Figure 6:
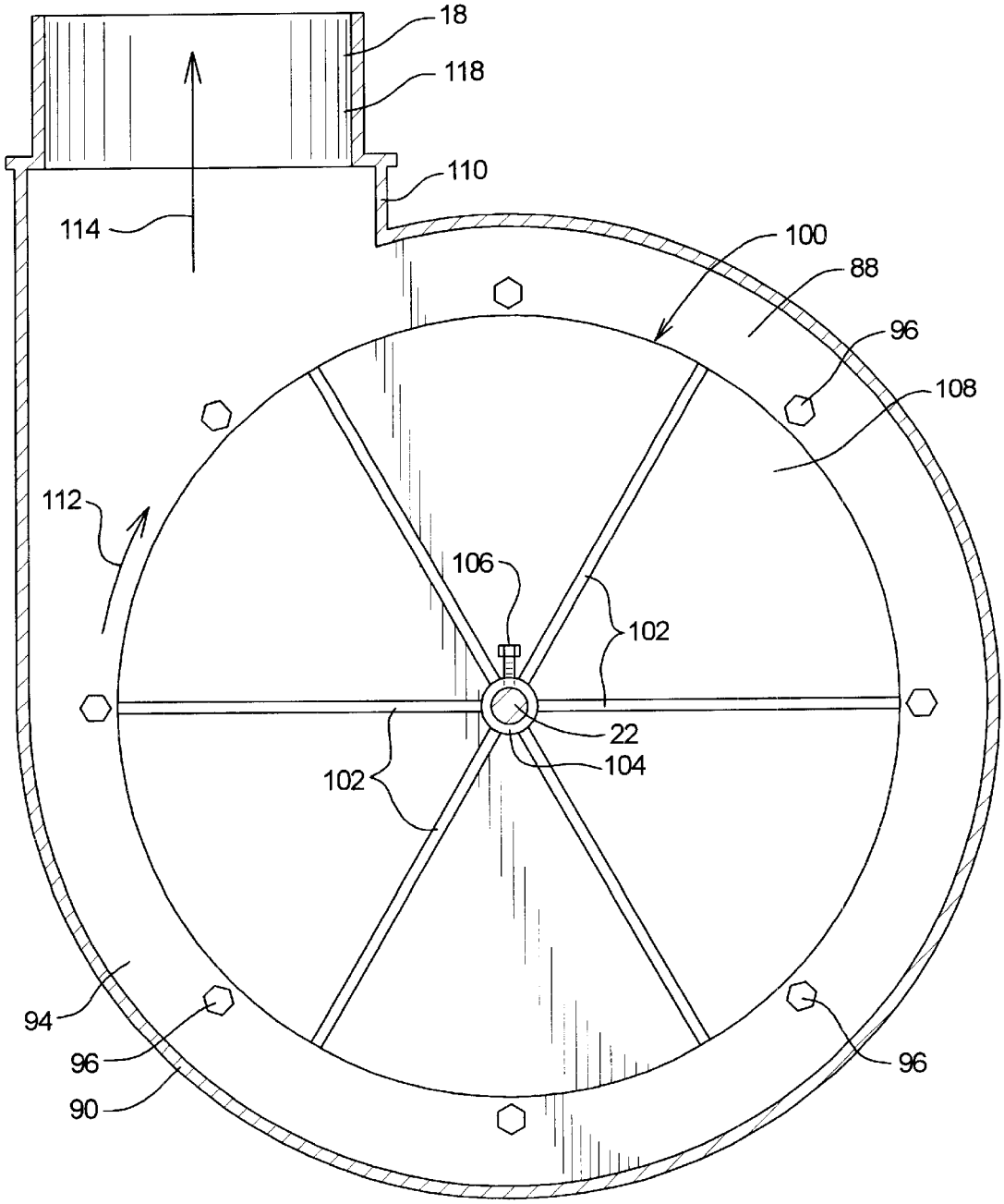
FIG. 6 is a cross-sectional view, taken along line 6—6 in FIG. 3, showing the configuration of the vanes in the blower section of the assembly.

As can be seen in FIG. 6, the blower section 16 is provided with a tangential chute 110 that leads to the discharge opening 18. Thus, the rotation of the blower fan in the direction indicated by arrow 112 causes the airborne chips to be discharged under pressure through opening 18, in the direction indicated by arrow 114. The chips may be discharged directly from opening 18, or a second conduit 116 (see FIG. I) may be attached to collar 118 for conveying the chips to a separate collection area.

b. Operation

To initiate operation, the drive motor 20 is energized so as to rotate shaft 22, thereby rotating both the cutter blade in chipper section 12 and the fan in blower section 16.

The suction generated by the blower fan draws the wood scraps through conduit 30, so that these enter the chipper section. Within the chipper section, the wood scraps are drawn against the chipper grate 32 by the suction, where they are cut and sheared by the rotating blade 56. As was noted above, the anvil plate 66 prevents the scraps from simply spinning freely within the chipper section and is also a cutting edge in itself, thereby ensuring efficient chipping action.

When the chips pass through the grate and into the blower section 16, they are picked up by the rotating vanes 102 and discharged under pressure through conduit 116 to a collection area. Because the apparatus reduces the scraps to wood chips of a comparatively small, somewhat uniform size, they are readily saleable in this form for a variety of purposes, e.g., for use in landscaping, for use in stalls or barns for horses or livestock, and for use on playgrounds and as fill in swampy areas.

The sizes of the components used in apparatus will depend in part on the size of the wood scraps to be processed. For example, using a 5 HP electric motor, an assembly like that shown in the figures has been constructed which readily vacuums up and chips short 2×4 and 2×6 end scraps. A slightly larger, three-phase 10–15 HP electric motor has been found to provide excellent performance for use at the majority of woodworking operations, but this is still far less expensive to operate than the 30 HP motor typically required by a hammer hog.

The combined chipper and blower sections of the present invention (in addition to providing the vacuum) also eliminates the need for a separate blower or conveyor to move the chips away from the discharge end of the apparatus, thus further reducing capital, operating, and maintenance costs: the single-motor assembly described above is capable of blowing chips 100 yards or more through a discharge hose or pipe, into a truck or other designated holding area.

c. Chipper Blade

As was noted above, the chipper section of the embodiment of the invention that is illustrated herein preferably employs a blade 56 having a "stepped" configuration. The stepped blade is generally rectangular in plan view, i.e., this is generally a rectangular piece having first and second cutting ends; it will be understood, however, that in other embodiments a chipper blade having fewer or more cutter ends (e.g., three ends) having the stepped construction may be employed.

Figure 7:
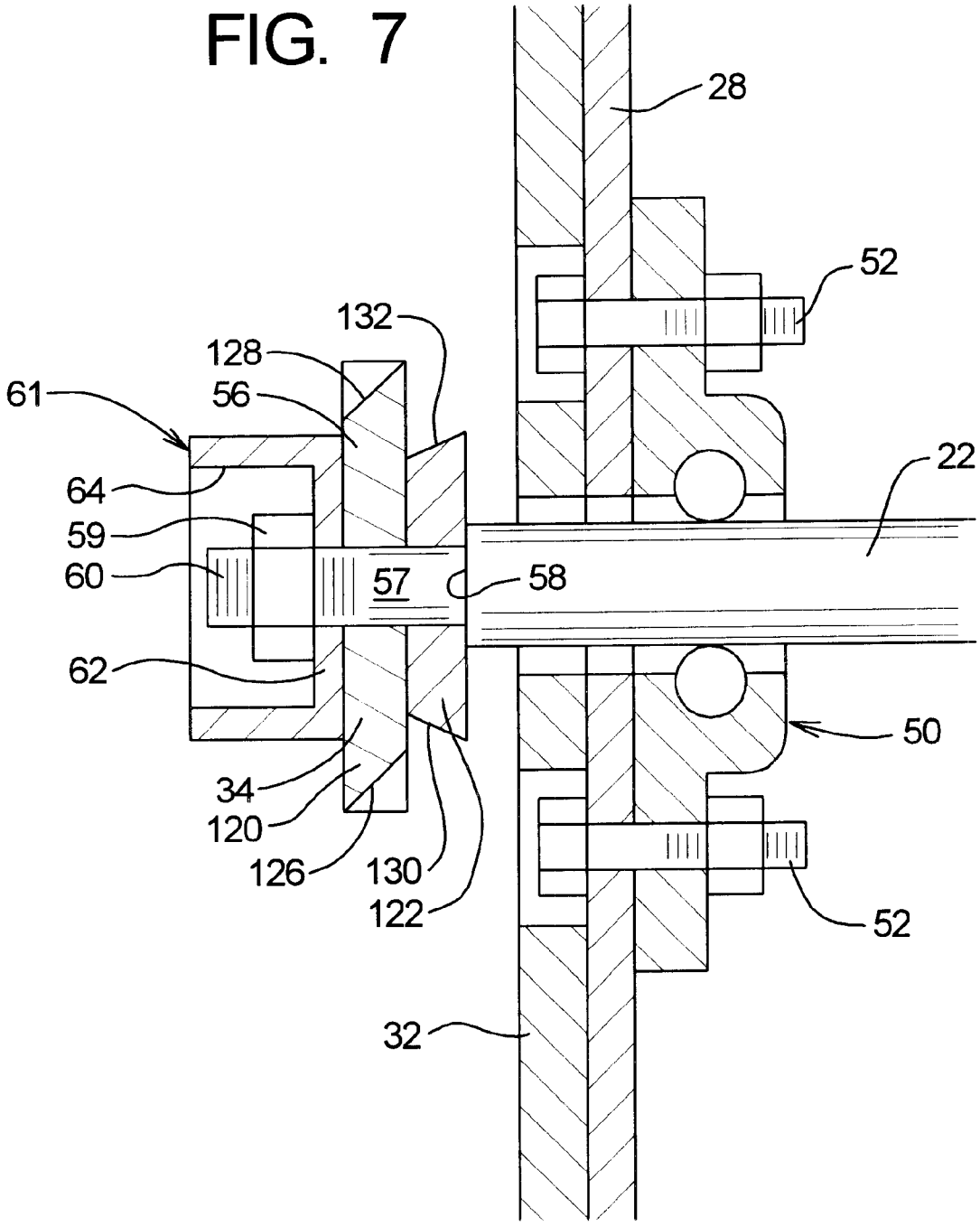
FIG. 7 is an enlarged, cross-sectional view of the end of the drive shaft of the chipper-blower assembly of FIGS. 1–6, showing the configuration of the chipper blade in greater detail.

As can best be seen in FIG. 7, each cutting end of the stepped blade has a comparatively wide upper (or outer) section 120, and a somewhat narrower lower (or inner) section 122, which extends parallel to the upper section 120. In the embodiment which is illustrated in the figures, the upper and lower blade sections 120, 122 are formed as separate pieces which are joined in face-to-face relationship by bolts 124: this makes manufacturing blade and sharpening of cutting faces easier, and also makes it possible to reverse the blade sections for extended service life; it will be understood, however, that in some embodiments the upper and lower sections may be formed as parts of a unitary, one-piece blade structure.

As can be seen in FIG. 7, the upper blade section 120 is provided with leading and trailing cutting faces 126, 128. These extend at a relatively sharp cutting angle (e.g., approximately 45°), which provides a comparatively keen edge for initial penetration and cutting of the wood scraps. Moreover, the comparatively sharp angle of the leading cutting edge 126 aids in drawing air and debris towards the chipping grate when rotated (see also FIG. 4), something in the manner of a propeller blade, thereby augmenting the suction force which is generated by the blower section. The trailing cutting face 128 is substantially identical to the leading cutting face, but is angled in the opposite direction (i.e., it extends parallel to leading cutting face 126), which allows the blade to be flipped over so as to present a fresh cutting edge when the first cutting face becomes worn. In some embodiments, however, only a single, leading cutting face may be provided.

The lower blade section 122 is also provided with leading and trailing cutting faces 130, 132. Rather than being sharply angled, however, the cutting faces of the lower blade section are angled or chamfered only slightly (e.g., 5–10°), and in the opposite direction from the corresponding cutting face in the upper blade section. The leading cutting face 130 of the lower direction from the corresponding cutting face in the upper blade section. The leading cutting face 130 of the lower blade section thus cooperates with the edges of the grate openings 82 to develop a shearing action, which shears and cuts off scraps which are lodged in the openings, rather than tending to push them on through. This helps to ensure that all scraps are reduced to the desired maximum size, and also prevents debris from building up between the primary (upper) blade section and the chipper plate. The slight back angle of the cutting face 130 serves to develop a clean shearing action without creating a deep channel or recess which might collect debris at the joint between the upper and lower blade section. While a slight rearward angle is thus preferred, it will be understood that in some embodiments the cutting faces 130, 132 of the lower blade section may be perpendicular or possibly angled somewhat forwardly. Furthermore, it should be understood that having the cutting faces 130, 132 on both sides of the lower blade section has the advantage of reversibility, by simply removing bolts 124 and rotating the lower blade section 180°, but that in some embodiments the lower blade section may be formed with only a single cutting face.

The chipper blade 56 is preferably formed of hardened steel to provide good edge retention and long service life, but not so hard as to develop a tendency to shatter during use.

d. Vertical Feed

Figure 8:
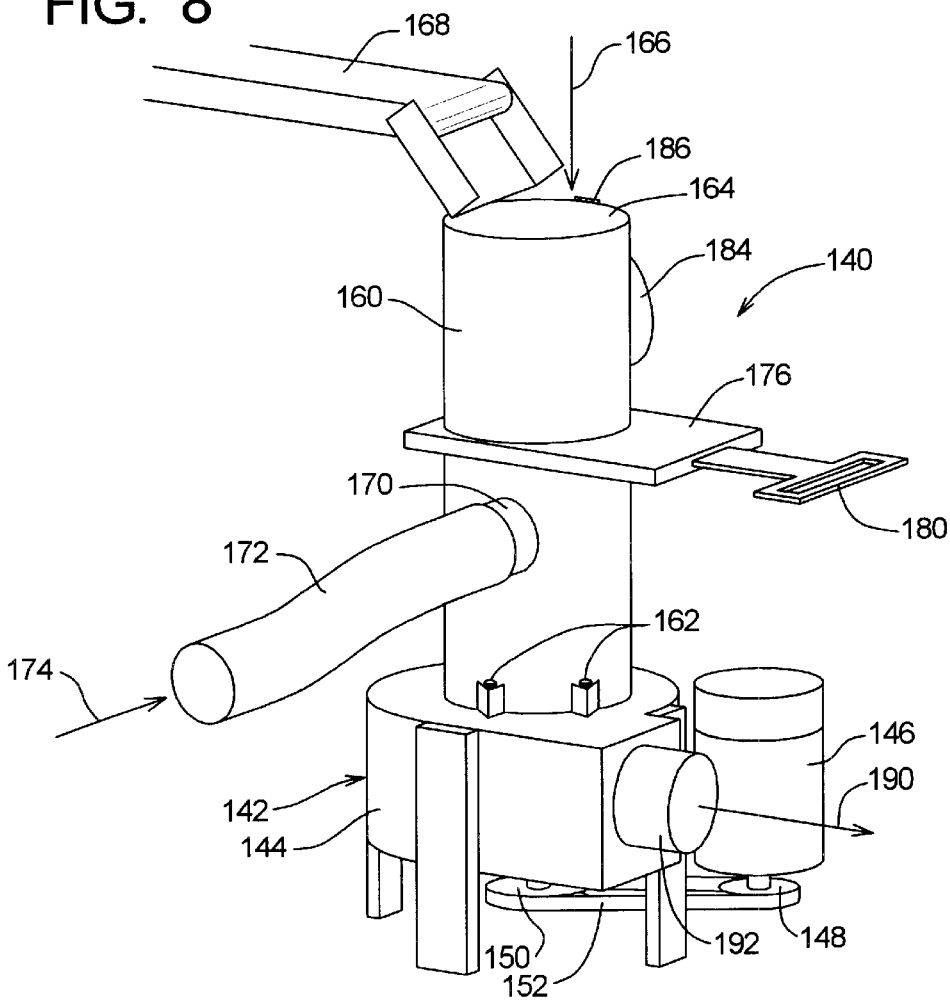
FIG. 8 is a perspective view of a wood scrap removal and chipping apparatus in accordance with another embodiment of the present invention, in which the chipper and blower sections are arranged horizontally so that wood scraps enter the apparatus through a vertically extending feed chute.

FIG. 8 illustrates an embodiment of the present invention in which the apparatus is oriented for receiving the wood scraps in a generally vertical direction, rather than the scraps entering in a horizontal direction as shown in FIG. 1. The vertical-feed embodiment provides certain advantages in terms of being able to handle comparatively long pieces of wood, and also being able to receive wood scraps by gravity feed from a conveyer, as will be described in greater detail below.

As can be seen, the vertical-feed embodiment 140 includes a combination chipper-blower assembly 142 that is substantially similar to that described above, except that the chipper section 144 and blower section (not visible in FIG. 8) are arranged horizontally, i.e., their blades/vanes rotate in the horizontal plane and their rotational axes are aligned in a vertical direction. Similar to the embodiment described above, the blower-chipper assembly is driven by an electric motor 146 mounted to the assembly, via pulleys 148, 150 and drive belt 152. First and second flange bearings are preferably used to support the vertically aligned drive shaft, rather than using a pillow block bearing as described above.

The vertical chute 160 is detachably mounted to the blower section 144 by a series of bolts 162, and extends over the chipper section in place of the housing described above. The feed chute 160 is suitably formed of a section of pipe, with its upper end 164 being open to receive the wood scraps as these are fed into the assembly in the direction indicated by arrow 166. The open upper end of the feed chute may therefore be positioned beneath the end of a conveyer 168 or other transport mechanism to receive wood scraps that are discharged therefrom, or, if desired, the material may be fed in to the top opening by hand. The vertical length (e.g., 1–6 feet or more) of the chute cooperates with the vacuum created by the chipper and blower sections to prevent scrap from being "kicked" back up through the opening 164, and also stabilizes boards and other long pieces so that they can be fed into the assembly safely and with a minimum of effort.

Figure 9A:
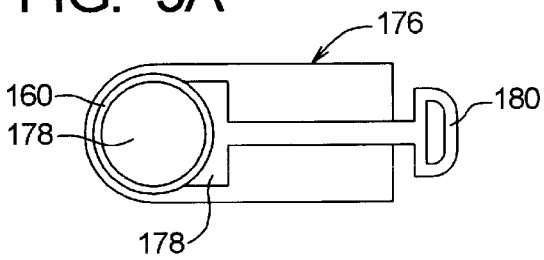
FIGS. 9A and 9B are first and second plan, somewhat schematic views of a valve that is mounted in the feed chute of the apparatus of FIG. 8, showing the manner in which the valve is opened and closed to control the flow of feed material and air through the chute.

A horizontal intake pipe 170 is mounted along the side of the vertical feed chute 160, preferably towards the lower end thereof, and is connected to a flexible hose 172 or other conduit for vacuuming up scrap material in the manner previously described, in the direction indicated by arrow 174. The vertical feed chute 160 is preferably provided with a closure mechanism for selectively blocking air flow through the upper end of the chute, so as to maximize the vacuum that is supplied to the horizontal intake when the latter is in use. For example, a blast valve 176 may be mounted across the chute at a position upstream from the horizontal intake. As can be seen in FIG. 9A, the blast valve includes a horizontal baffle 178 or similar plate member that extends across and blocks the throat of chute 160 when in an inserted position.

Figure 9B:
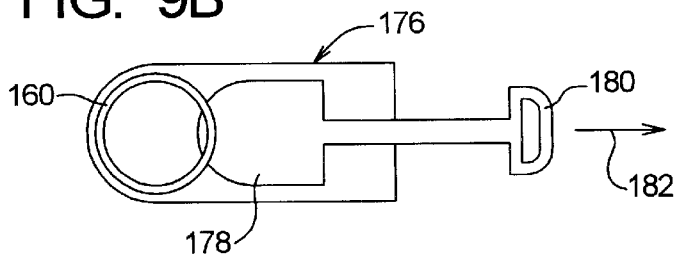

The baffle is mounted to a handle 180 that allows it to be selectively withdrawn from the chute, in the direction indicated by arrow 182 in FIG. 9B, when it is desired to open the chute for vertical feeding of the wood scraps.

As can be seen in FIG. 8, an upper end enclosure can also be provided, such as a lid 184 that is mounted to the lip of the chute by hinge 186, so as to cover the open upper end of the chute when this is not being used for vertical feeding. It will be understood in some embodiments the function of closing off the vertical chute may be performed by either a lid or a blast valve, so that both may not be present in all embodiments. Furthermore, it will be understood that both the lid and the blast valve may have any other suitable configurations, including a variety of flaps, panels, lids, and so on.

As the wood scraps enter the assembly through the vertical chute 160 or the horizontal intake 170, these are processed by the chipper and blower sections and discharged in the direction indicated by arrow 190, in substantially the same manner as previously described. Also was as described above, a flexible hose or other conduit may be mounted to the collar 192 of the discharge opening, for conveying the wood chips to a bin, truck, or other designated holding area.

It has been found that the stationary anvil described above is less critical to performance in the vertical feed configuration (possibly due to the force of gravity helping to hold the scrap material against the chipper grate), so this may be dispensed with in some embodiments. Furthermore, the feed chute may be aligned vertically as shown, or may be aligned at a selected upward angle (e.g., 45 degrees), depending on the manner in which the scraps are to be fed into the assembly.

It is to be recognized that various alterations, modifications, and/or additions may be introduced into the constructions and arrangements of parts described above without departing from the spirit or ambit of the present invention.

What is claimed is:

1. An apparatus for receiving wood scraps from a work area and reducing said scraps to wood chips having a predetermined consistency and size, said apparatus comprising:

a chipper section for reducing said wood scraps to said wood chips, said chipper section comprising:

a chipper grate having a flat, substantially planar intake face and a plurality of through openings; and a rotating cutter blade for reducing said scraps to said wood chips as said wood scraps are drawn against said chipper grate and said wood chips are drawn through said grate, said rotating blade being positioned to rotate in parallel, closely spaced relationship with said flat, planar intake face of said chipper grate and comprising upper and lower stepped blade sections, said upper blade section having a sharply angled leading edge for penetrating and cutting said wood scraps and for drawing air and debris towards said chipper grate, and said lower blade section having a substantially planar lower surface for passing closely over and parallel to said intake face of said chipper grate and a bluntly angled leading edge for shearing said wood scraps as said scraps enter said through openings in said grate; and a blower section for drawing said scraps into said chipper section, and then drawing said chips from said chipper section and discharging said chips to a predetermined collection area;

said chipper and blower sections being mounted together with said chipper section in fluid communication with an intake side of said blower section.

2. The apparatus of claim 1, wherein said through openings in said chipper grate are sized to permit chips having a predetermined maximum size to pass therethrough.

3. The apparatus of claim 2, wherein said through openings in said chipper grate have a plurality of teeth formed along edges thereof for temporarily holding said wood chips as said chips are sheared by said rotating blade.

4. The apparatus of claim 1, wherein said blower section comprises:

a blower fan for generating a flow of air for drawing said wood scraps into said chipper section and for discharging said wood chips from said blower section.

5. The apparatus of claim 4, wherein said blower fan comprises:

a plurality of rotating vanes positioned behind said chipper grate so as to receive said wood chips which pass therethrough.

6. The apparatus of claim 5, wherein said blower section further comprises:

a housing surrounding said blower fans, against which said wood chips are discharged by said rotating vanes of said blower fan.

7. The apparatus of claim 6, wherein said blower section further comprises:

a tangentially extending opening in said housing for outward discharge of said wood chips therethrough.

8. The apparatus of claim 7, further comprising:

a conduit mounted to said opening in said housing of said blower section for conveying said wood chips discharged therefrom to said predetermined collection area.

9. The apparatus of claim 5, wherein said rotating blade and blower fan are mounted on a common driveshaft.

10. The apparatus of claim 9, further comprising:

a motor operatively connected to said driveshaft for rotating said blade and fan mounted thereto.

11. The apparatus of claim 1, wherein said chipper section further comprises:

an intake opening for directing said wood scraps towards said rotating blade and chipper grate in said chipper section.

12. The apparatus of claim 11, further comprising:

a conduit mounted to said intake opening of said chipper section for conveying said wood scraps by vacuum from said work area to said chip section of said apparatus.

13. The apparatus of claim 12, wherein said conduit comprises:

a flexible hose for collecting said wood scraps from locations throughout said work area.

14. The apparatus of claim 11, further comprising:

a feed chute mounted to said intake opening for conveying said wood scraps by gravity and vacuum to said chipper section of said apparatus.

15. The apparatus of claim 14, wherein said feed chute is aligned in an upwardly extending direction and has an opening at an upper end thereof for receiving said wood scraps from said work area.

16. The apparatus of claim 15, wherein said feed chute further comprises:

a second intake opening formed in a side of said chute; and a conduit mounted to said second intake opening for conveying said wood scraps by vacuum to said chipper section of said apparatus.

17. The apparatus of claim 16, wherein said feed chute further comprises:

means for selectively blocking flow of air through said upper end of said feed chute so as to maximize vacuum applied to the said conduit.

18. The apparatus of claim 17, wherein said means for blocking flow of air through said upper end of said feed chute comprises:

a valve mounted in said feed chute for controlling flow of air through said chute.

19. The apparatus of claim 1, wherein said chipper section further comprises:

a stationary anvil plate mounted in said chipper section above said rotating blade so as to block said wood scraps from rotating freely in said blower section and so as to force said scraps into cutting engagement with said rotating blade.

20. An apparatus for receiving wood scraps and reducing said scraps to wood chips having a predetermined consistency and size, said apparatus comprising:

a chipper grate having a flat, substantially planar intake face and a plurality of through openings; and a rotating cutter blade for reducing said scraps to said wood chips as said scraps pass through said chipper grate, said rotating blade being positioned to rotate in parallel, closely spaced relationship with said flat, planar intake face of said chipper grate and comprising upper and lower stepped blade sections, said upper blade section having a sharply angled leading edge for penetrating and cutting said wood scraps and for drawing air and debris towards said chipper grate, and said lower blade section having a substantially planar lower surface for passing closely over and parallel to said intake face of said chipper grate and a bluntly angled leading edge for shearing said wood scraps as said scraps enter said through openings in said grate.

21. The apparatus of claim 20, wherein said lower blade section comprises a substantially solid lower blade member.

22. The apparatus of claim 21, wherein said bluntly angled leading edge of said lower blade section extends at an angle of about 5° to about 10° in a direction opposite said sharply angled leading edge of said upper blade section.

23. The apparatus of claim 22, wherein said sharply angled leading edge of said upper blade section extends at a forward angle of about 45°.

24. The apparatus of claim 20, wherein said through openings in said chipper grate comprise a multiplicity of inwardly projecting teeth formed along perimeters of said openings for temporarily holding said wood chips in said openings as said chips are sheared by said rotating cutter blade.

25. The apparatus of claim 20, wherein said through openings in said chipper grate comprise curved, generally arcuate edges that converge in a direction of rotation of said cutter blade so as to form pointed jaw areas for temporarily capturing said wood chips in said openings as said chips are sheared by said rotating blade.

* * * * *